US010271664B2

(12) United States Patent
Yan

(10) Patent No.: US 10,271,664 B2
(45) Date of Patent: Apr. 30, 2019

(54) SEAT CUSHION-FOLDABLE BABY CARRIER

(71) Applicant: Chengxiao Yan, Fujian (CN)

(72) Inventor: Chengxiao Yan, Fujian (CN)

( * ) Notice: Subject to any disclaimer, the term of this patent is extended or adjusted under 35 U.S.C. 154(b) by 0 days.

(21) Appl. No.: 15/760,231

(22) PCT Filed: Aug. 9, 2017

(86) PCT No.: PCT/CN2017/096574
§ 371 (c)(1),
(2) Date: Mar. 15, 2018

(87) PCT Pub. No.: WO2018/126681
PCT Pub. Date: Jul. 12, 2018

(65) Prior Publication Data

US 2019/0053637 A1 Feb. 21, 2019

(30) Foreign Application Priority Data

Jan. 5, 2017 (CN) ..... 2017 2 0009820 U

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
(Continued)

(56) References Cited

U.S. PATENT DOCUMENTS 5,222,641 A * 6/1993 Medeiros, Jr. ..... A47D 13/025 224/161
5,381,941 A * 1/1995 Brune ..... A45F 3/26 224/153

(Continued)

*Primary Examiner* — Corey N Skurdal
(74) *Attorney, Agent, or Firm* — JCIPRNET

(57) ABSTRACT

A seat cushion-foldable baby carrier is disclosed. A seat cushion includes a hipseat detachably mounted on a carrier body. A supporting portion and a bearing portion of the hipseat are connected by rotating a switch button to form a foldable body sheathed in a bushing. A connecting shaft included in each of a left switch button and a right switch button is fixed on a side portion of the supporting portion after sequentially running through a bearing connection base, a switch control lock, and a spring. One end of the switch control lock is movable in a left/right direction to be inserted into the side portion of the supporting portion, and the other end is provided with at least two limiting grooves. The spring presses against the side portion of the switch control lock and the side portion of the supporting portion. The bearing connection base is connected to the bearing portion, and is protrudingly provided with an engaging bump corresponding to the limiting groove of the switch control lock. A button member is movable in a left/right direction to be engaged with the bearing connection base, and abuts against the switch control lock. The baby carrier has a simple structure and small volume, and is secure and reliable. Because the baby carrier can be easily folded to various shapes, not only an object accommodation space is provided when the baby carrier is used, but also a storage space is greatly saved when the baby carrier is not used. Therefore, the baby carrier is extremely portable.

8 Claims, 11 Drawing Sheets

(58) Field of Classification Search
USPC ..... 224/159–161, 270
See application file for complete search history.

(56) References Cited

U.S. PATENT DOCUMENTS

| | | | | | |
|---|---|---|---|---|---|
| 5,496,092 | A * | 3/1996 | Williams | A61F 5/3792 | 297/250.1 |
| 5,509,590 | A * | 4/1996 | Medeiros, Jr. | A47D 13/025 | 224/161 |
| 5,527,089 | A * | 6/1996 | Charest | A45F 4/02 | 224/155 |
| 5,662,339 | A * | 9/1997 | Svendsen | A47D 13/025 | 224/153 |
| 6,662,981 | B2 * | 12/2003 | McUmber | A45F 3/10 | 224/155 |
| 9,307,846 | B1 * | 4/2016 | Jones | A47D 13/025 | |
| 9,314,113 | B1 * | 4/2016 | Lehan | A47D 13/025 | |
| 2008/0047987 | A1 * | 2/2008 | Price | A47D 13/025 | 224/159 |
| 2010/0133303 | A1 * | 6/2010 | Schilly | A45F 3/10 | 224/155 |
| 2016/0286980 | A1 * | 10/2016 | Telford | A47D 13/025 | |
| 2018/0084923 | A1 * | 3/2018 | Kang | A47D 13/025 | |

* cited by examiner

SEAT CUSHION-FOLDABLE BABY CARRIER

CROSS-REFERENCE TO RELATED APPLICATION

This application is a 371 application of the international PCT application serial no. PCT/CN2017/096574, filed on Aug. 9, 2017, which claims the priority benefit of China application no. 201720009820.6, filed on Jan. 5, 2017. The entirety of each of the abovementioned patent applications is hereby incorporated by reference herein and made a part of this specification.

BACKGROUND OF THE INVENTION

1. Field of the Invention

The present utility model relates to a baby carrier, and in particular, to a foldable hipseat baby carrier.

2. Description of Related Art

Currently, the use of baby carriers frees more parents from holding children with hands. This not only helps parents save labor, but also allows babies to have more body touches with their parents. In this way, babies feel very safe and parents can keep an eye on babies at any time to know the condition of the babies. At present, a hipseat baby carrier suitable for babies elder than 6 months is increasingly popular. As shown in FIG. 10 and FIG. 11, an existing hipseat baby carrier includes a seat cushion 2 connected to a lower part of a back cushion 1. The seat cushion 2 is directly formed by a block-shaped seat cushion 21. The seat cushion 21 is wrapped in a body of the baby carrier. In this way, although a function of the seat cushion is achieved, a lot of space is occupied. Consequently, the entire baby carrier has an excessively large volume and is not portable, and also looks clumsy.

SUMMARY OF THE INVENTION

For the problem in the prior art, the present utility model provides a seat cushion-foldable baby carrier. The baby carrier has a simple structure and small volume, and is secure and reliable. Because the baby carrier can be easily folded to various shapes, not only an object accommodation space is provided when the baby carrier is used, but also a storage space is greatly saved when the baby carrier is not used. Therefore, the baby carrier is extremely portable.

To achieve the foregoing objective, the technical solutions of the present utility model are:

A seat cushion-foldable baby carrier, including a seat cushion connected to a carrier body, where the seat cushion includes a hipseat detachably mounted on the carrier body, the hipseat includes a supporting portion and a bearing portion, the supporting portion and the bearing portion are connected by rotating a switch button to form a foldable body, and the foldable body is sheathed in a bushing, to form a seat-cushion shape mounted on the carrier body; the switch button includes a left switch button and a right switch button disposed on two sides of the supporting portion, each of the left switch button and the right switch button includes a connecting shaft, and the connecting shaft is fixed on a side portion of the supporting portion after sequentially running through a bearing connection base, a switch control lock, and a spring, wherein one end of the switch control lock is movable in a left/right direction to be inserted into the side portion of the supporting portion, and the other end is provided with at least two limiting grooves; the spring presses against the side portion of the switch control lock and the side portion of the supporting portion; the bearing connection base is connected to the bearing portion, and is protrudingly provided with an engaging bump corresponding to the limiting groove of the switch control lock; and the hipseat further includes a button member, where the button member is movable in a left/right direction to be engaged with the bearing connection base, and abuts against the switch control lock.

The seat cushion-foldable baby carrier according to the foregoing description, where the supporting portion is tabular-shaped, and the bearing portion is hollow ring-shaped with an opening.

The seat cushion-foldable baby carrier according to the foregoing description, where an angle of 90-140 degrees exists between the supporting portion and the bearing portion when the engaging bump of the bearing connection base is engaged with one of the limiting grooves of the switch control lock.

The seat cushion-foldable baby carrier according to the foregoing description, where a plurality of mounting holes are provided on the side portion of the supporting portion, a plurality of engaging teeth are provided on the switch control lock, and the engaging teeth are correspondingly inserted into the mounting holes, so that the switch control lock can move in the left/right direction to be inserted into the supporting portion.

Beneficial effects of the foregoing technical solutions are:

The seat cushion of the carrier in the present utility model is a hipseat that can be easily folded to various shapes instead of a one-piece block-shaped seat cushion in the prior art. During use, a most suitable angle of 90-140 degrees is formed by gently pressing the button member, and a comfortable hipseat is formed by matching a bushing with the supporting portion and the bearing portion that are tightly locked by using the left switch button and the right switch button. In this way, the hipseat supports a baby and makes the baby enjoy being carried in the arms of parents. In addition, the hipseat formed by the tabular-shaped supporting portion and the hollow ring-shaped bearing portion having an opening leaves most space for the seat cushion. When the baby carrier is not used, the supporting portion is folded toward the bearing portion by gently pressing the button member and is tightly locked by using the left switch button and the right switch button, so that a storage space is greatly saved when the baby carrier is not used, and the baby carrier is more portable, thereby bringing great convenience to a user.

BRIEF DESCRIPTION OF THE DRAWINGS

The accompanying drawings described herein are used to provide a further understanding of the present utility model and form a part of the present utility model. Exemplary embodiments of the present utility model and descriptions thereof are used to explain the present utility model, and do not constitute any inappropriate limitation to the present utility model. In the figures.

DESCRIPTION OF THE EMBODIMENTS

To make the technical problems to be resolved, the technical solutions, and the beneficial effects of the present utility model clearer, the following further describes the present utility model in detail with reference to the accompanying drawings and embodiments. It should be understood that the specific embodiments described herein are merely for explaining the present utility model, and are not intended to limit the present utility model.

Figure 1:
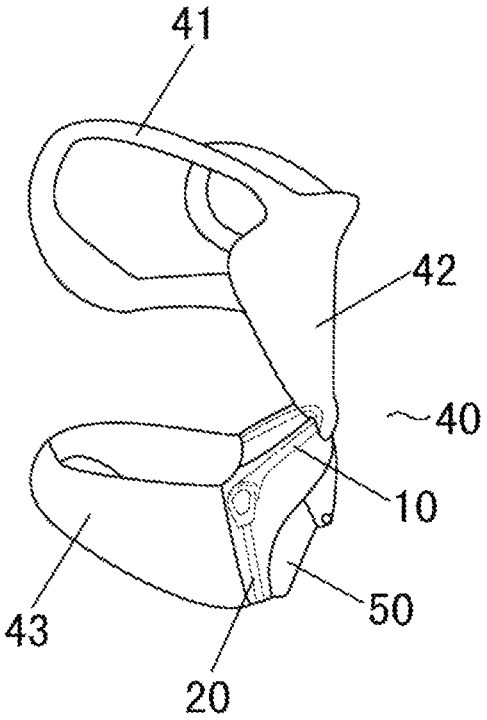
FIG. 1 is a schematic three-dimensional structural diagram of a carrier according to the present utility model.
Figure 2:
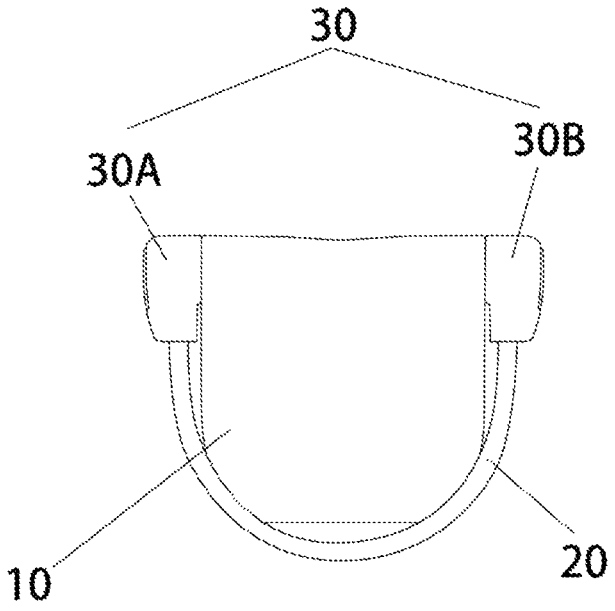
FIG. 2 is a schematic front view structural diagram of a folded state of a hipseat according to the present utility model.
Figure 3:
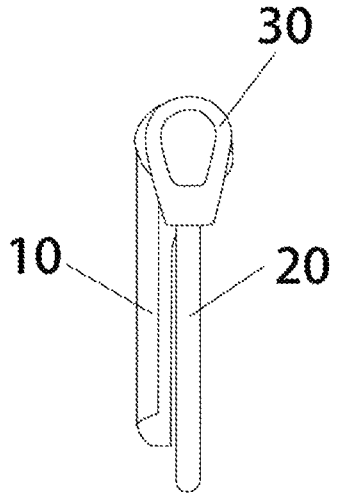
FIG. 3 is a schematic side view structural diagram of a folded state of a hipseat according to the present utility model.

FIG. 1 shows a seat cushion-foldable baby carrier. A carrier body 40 has a back cushion 42 connected to shoulder straps 41 and a seat cushion 50 connected to a waistband 43. The seat cushion 50 is connected to a lower part of the back cushion 42. The seat cushion 50 includes a hipseat detachably mounted on the carrier body 40. The hipseat includes a supporting portion 10 and a bearing portion 20. The supporting portion 10 and the bearing portion 20 are connected by rotating a switch button 30 to form a foldable body. The foldable body is sheathed in a bushing, to form a seat-cushion shape mounted on the carrier body 40.

A hipseat shown in FIG. 2 to FIG. 6 includes a supporting portion 10 and a bearing portion 20. The supporting portion 10 and the bearing portion 20 are connected by rotating a switch button 30. The supporting portion 10 is tabular-shaped, to provide a sufficient support area and support force for a baby. The bearing portion 20 is hollow ring-shaped with an opening, thereby fully reducing the weight and the volume of the hipseat and leaving most space for a seat cushion.

Figure 6:
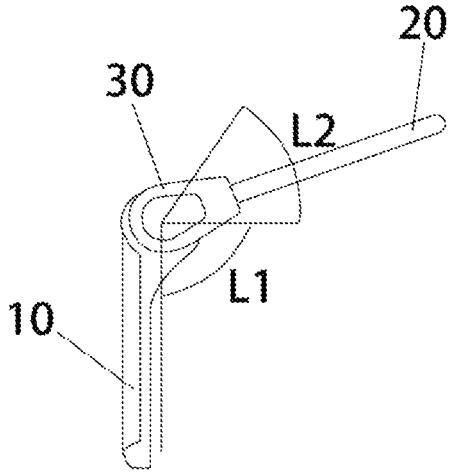
FIG. 6 is a schematic side view structural diagram of an unfolded state of a hipseat according to the present utility model (in the figure, L1 indicates 0-90 degrees, and L2 indicates 90-140 degrees).
Figure 7:
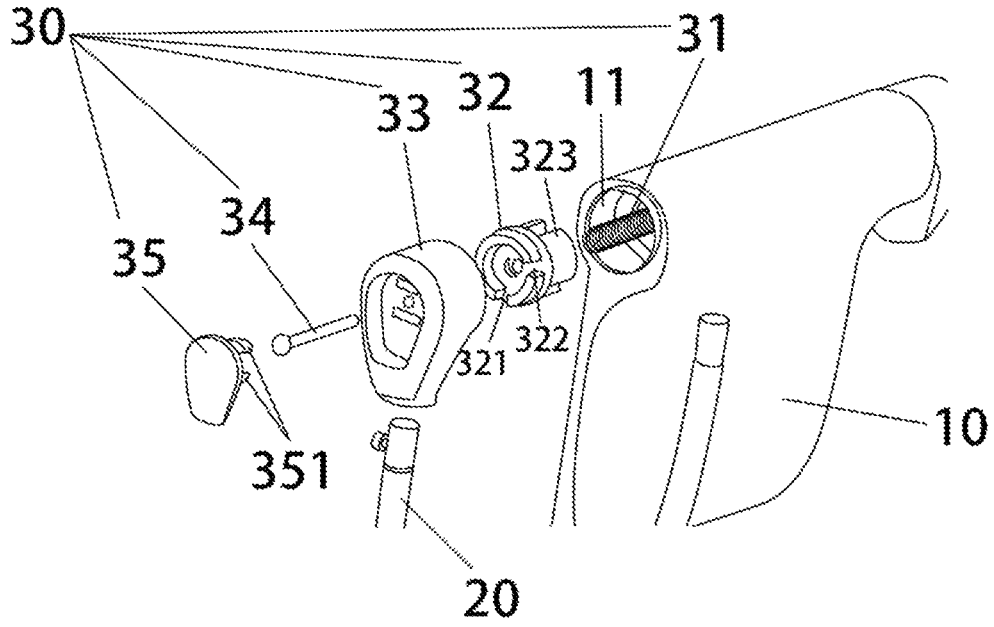
FIG. 7 is a schematic three-dimensional exploded structural diagram of a switch button according to the present utility model.
Figure 8:
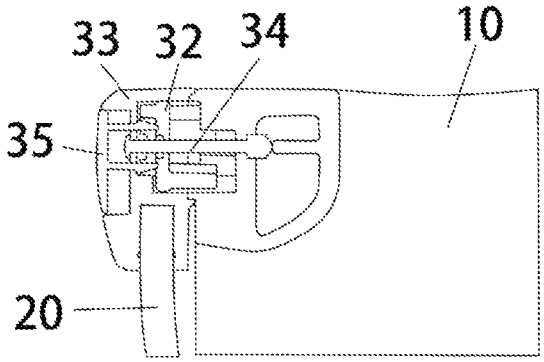
FIG. 8 is a schematic cross-sectional structural diagram of a switch button according to the present utility model.
Figure 9:
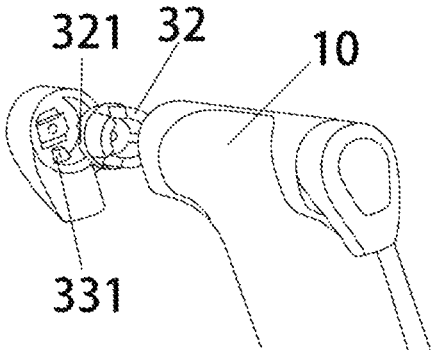
FIG. 9 is a schematic three-dimensional exploded view of a connection structure between a bearing connection base and a switch control lock according to the present utility model.
Figure 10:
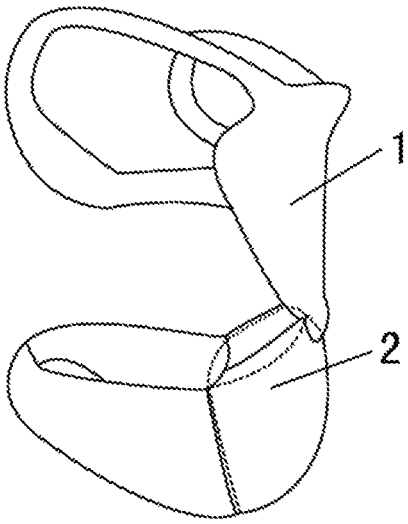
FIG. 10 is a schematic three-dimensional structural diagram of a baby carrier in the prior art.
Figure 11:
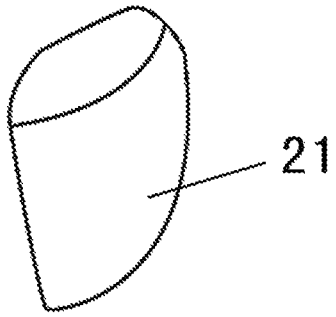
FIG. 11 is a schematic three-dimensional structural diagram of a hipseat in the prior art.

Referring to FIG. 7 to FIG. 9, the switch button 30 includes a left switch button 30A and a right switch button 30B disposed on two sides of the supporting portion 10. To turn on or off the switch button 30, the left switch button 30A and the right switch button 30B need to be pressed at the same time. The switch button 30 cannot be turned on or off when only one of the left switch button 30A and the right switch button 30B is pressed. Specific structures of the left switch button 30A and the right switch button 30B are shown in FIG. 6 and FIG. 7. Each of the left switch button 30A and the right switch button 30B includes a connecting shaft 34. The connecting shaft 34 is a screw. The screw is threaded connected to and fixed on a side portion of the supporting portion 10 after sequentially running through a bearing connection base 33, a switch control lock 32, and a spring 31.

A plurality of engaging teeth 323 are provided on one end of the switch control lock 32 in the present utility model. Correspondingly, a plurality of mounting holes 11 are provided on the side portion of the supporting portion 10. The plurality of engaging teeth 323 of the switch control lock 32 are correspondingly inserted into the plurality of mounting holes 11, so that the switch control lock 32 can elastically move in a left/right direction along a telescope direction of the spring 31 to be inserted into the side portion of the supporting portion 10. The other end of the switch control lock 32 is provided with at least two limiting grooves. In the present embodiment, there are two limiting grooves, which are a folding limiting groove 321 and an unfolding limiting groove 322.

The spring 31 in the present utility model is sleeved on the connecting shaft 34 and presses against the side portion of the switch control lock 32 and the side portion of the supporting portion 10.

Figure 4:
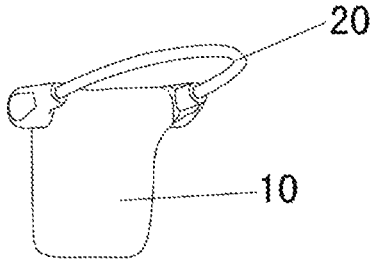
FIG. 4 is a schematic three-dimensional structural diagram of an unfolded state of a hipseat according to the present utility model.
Figure 5:
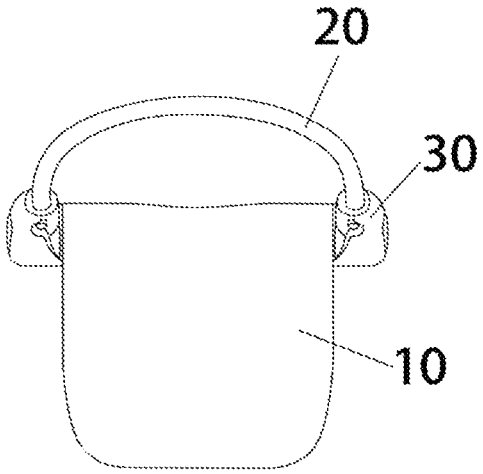
FIG. 5 is a schematic front view structural diagram of an unfolded state of a hipseat according to the present utility model.

As shown in FIG. 9, the bearing connection base 33 in the present utility model is a rotating body connected to the bearing portion 20. The connecting shaft 34 serves as a rotating shaft of the rotating body. An engaging bump 331 corresponding to the switch control lock 32 is provided on the bearing connection base 33. The engaging bump 331 fits with the folding limiting groove 321 and the unfolding limiting groove 322, so that the engaging bump 331 is engaged with one of the limiting grooves. In the present embodiment, referring to FIG. 2 and FIG. 3, when the engaging bump 331 is engaged with the folding limiting groove 321, the bearing connection base 33 points downward, that is, a folded state in which the bearing portion 20 is folded toward the supporting portion 10. As shown in FIG. 4 and FIG. 5, when the engaging bump 331 is engaged with the unfolding limiting groove 322, the bearing connection base 33 points forward, that is, an unfolded use state in which the bearing portion 20 is distant from the supporting portion 10. Optimally, as shown in FIG. 6, when the engaging bump 331 of the bearing connection base 33 is engaged with the unfolding limiting groove 322 of the switch control lock 32, an angle of 90-140 degrees exists between the supporting portion 10 and the bearing portion 20.

The hipseat in the present utility model further includes a button member 35. The button member 35 has two engaging legs 351. The two engaging legs 351 run through the bearing connection base 33 and are movable in a left/right direction to be engaged with the bearing connection base 33 by using a hook portion protruding from the engaging legs 351, thereby preventing the button member 35 from leaving the bearing connection base 33. When the bearing connection base 33 is rotated, the bearing portion 20 needs to be pressed in a direction opposite to an extending direction of the supporting portion 10, so that the supporting portion 10 and the bearing portion 20 are unlocked. The two engaging legs 351 of the button member 35 abut against the switch control lock 32 when the bearing portion 20 and the supporting portion 10 are relatively still to each other. Therefore, when the button member 35 is pressed, the bearing portion 20 is pushed at the same time until the supporting portion 10 and the bearing portion 20 are unlocked. In this way, the bearing connection base 33 can be freely rotated, to unfold or fold the bearing portion 20.

The foregoing shows and describes exemplary embodiments of the present utility model. As described above, it should be understood that the present utility model is not limited to the form disclosed in the specification, but may be used in various other combinations, modifications and environments without excluding other embodiments, and modifications may be made by using the foregoing teachings or technologies or knowledge in the related art within the inventive scope of the present utility model in the specification. Modifications and variations made by a person in the art without departing from the spirit and scope of the present utility model shall fall within the protection scope of the appended claims of the present utility model.

What is claimed is:

1. A seat cushion-foldable baby carrier, comprising a seat cushion connected to a carrier body, wherein: the seat cushion comprises a hipseat detachably mounted on the carrier body, the hipseat comprises a supporting portion and a bearing portion, the supporting portion and the bearing portion are connected by rotating a switch button to form a foldable body, and the foldable body is sheathed in a bushing, to form a seat-cushion shape mounted on the carrier body; the switch button comprises a left switch button and a right switch button disposed on two sides of the supporting portion, each of the left switch button and the right switch button comprises a connecting shaft, and the connecting shaft is fixed on a side portion of the supporting portion after sequentially running through a bearing connection base, a switch control lock, and a spring, wherein one end of the switch control lock is movable in a left/right direction to be inserted into the side portion of the supporting portion, and the other end is provided with at least two limiting grooves;

the spring presses against a side portion of the switch control lock and the side portion of the supporting portion;

the bearing connection base is connected to the bearing portion, and is protrudingly provided with an engaging bump corresponding to the limiting groove of the switch control lock; and the hipseat further comprises a button member, wherein the button member is movable in a left/right direction to be engaged with the bearing connection base, and abuts against the switch control lock.

2. The seat cushion-foldable baby carrier according to claim 1, wherein: the supporting portion is tabular-shaped, and the bearing portion is hollow ring-shaped with an opening.

3. The seat cushion-foldable baby carrier according to claim 2, wherein: an angle of 90-140 degrees exists between the supporting portion and the bearing portion when the engaging bump of the bearing connection base is engaged with one of the limiting grooves of the switch control lock.

4. The seat cushion-foldable baby carrier according to claim 3, wherein: a plurality of mounting holes is provided on the side portion of the supporting portion, a plurality of engaging teeth is provided on the switch control lock, and the engaging teeth are correspondingly inserted into the mounting holes, so that the switch control lock can move in the left/right direction to be inserted into the supporting portion.

5. The seat cushion-foldable baby carrier according to claim 2, wherein: a plurality of mounting holes is provided on the side portion of the supporting portion, a plurality of engaging teeth is provided on the switch control lock, and the engaging teeth are correspondingly inserted into the mounting holes, so that the switch control lock can move in the left/right direction to be inserted into the supporting portion.

6. The seat cushion-foldable baby carrier according to claim 1, wherein: an angle of 90-140 degrees exists between the supporting portion and the bearing portion when the engaging bump of the bearing connection base is engaged with one of the limiting grooves of the switch control lock.

7. The seat cushion-foldable baby carrier according to claim 6, wherein: a plurality of mounting holes is provided on the side portion of the supporting portion, a plurality of engaging teeth is provided on the switch control lock, and the engaging teeth are correspondingly inserted into the mounting holes, so that the switch control lock can move in the left/right direction to be inserted into the supporting portion.

8. The seat cushion-foldable baby carrier according to claim 1, wherein: a plurality of mounting holes is provided on the side portion of the supporting portion, a plurality of engaging teeth is provided on the switch control lock, and the engaging teeth are correspondingly inserted into the mounting holes, so that the switch control lock can move in the left/right direction to be inserted into the supporting portion.

* * * * *